United States Patent [19]

Hilgers et al.

[11] 3,943,538

[45] Mar. 9, 1976

[54] DEVELOPING APPARATUS WITH AUTOMATIC TEMPERATURE CONTROL

[75] Inventors: Horst Hilgers, Bad Schwalbach-Heimbach; Herbert Schröter, Taunusstein, both of Germany

[73] Assignee: Hoechst Aktiengesellschaft, Germany

[22] Filed: Feb. 21, 1974

[21] Appl. No.: 444,561

[30] Foreign Application Priority Data

Feb. 24, 1973 Germany ..... 2309303

[52] U.S. Cl. ..... 354/299; 34/48

[51] Int. Cl.[2] ..... G03D 13/00

[58] Field of Search ..... 354/297, 299, 300; 34/48

[56] References Cited

UNITED STATES PATENTS

| | | | |
|---|---|---|---|
| 2,058,983 | 10/1936 | Horn | 354/300 X |
| 2,096,015 | 10/1937 | Von Meister et al. | 354/300 X |
| 2,240,409 | 4/1941 | Morse | 354/299 X |
| 2,257,207 | 9/1941 | Von Meister et al. | 354/300 X |

FOREIGN PATENTS OR APPLICATIONS

| | | | |
|---|---|---|---|
| 1,020,931 | 2/1966 | United Kingdom | 354/300 |

*Primary Examiner*—Fred L. Braun
*Attorney, Agent, or Firm*—James E. Bryan

[57] ABSTRACT

In an apparatus for developing light-sensitive material with a gaseous medium comprising a developing station in communication with a vaporizer, at least one heater in each of said developing station and vaporizer, at least one temperature control inside said developing station, said control at a certain temperature in said developing station actuating said heater in said vaporizer, and said developing station attaining its predetermined temperature at the latest at the time when said vaporizer attains its predetermined temperature.

8 Claims, 3 Drawing Figures

DEVELOPING APPARATUS WITH AUTOMATIC TEMPERATURE CONTROL

Figure 1:
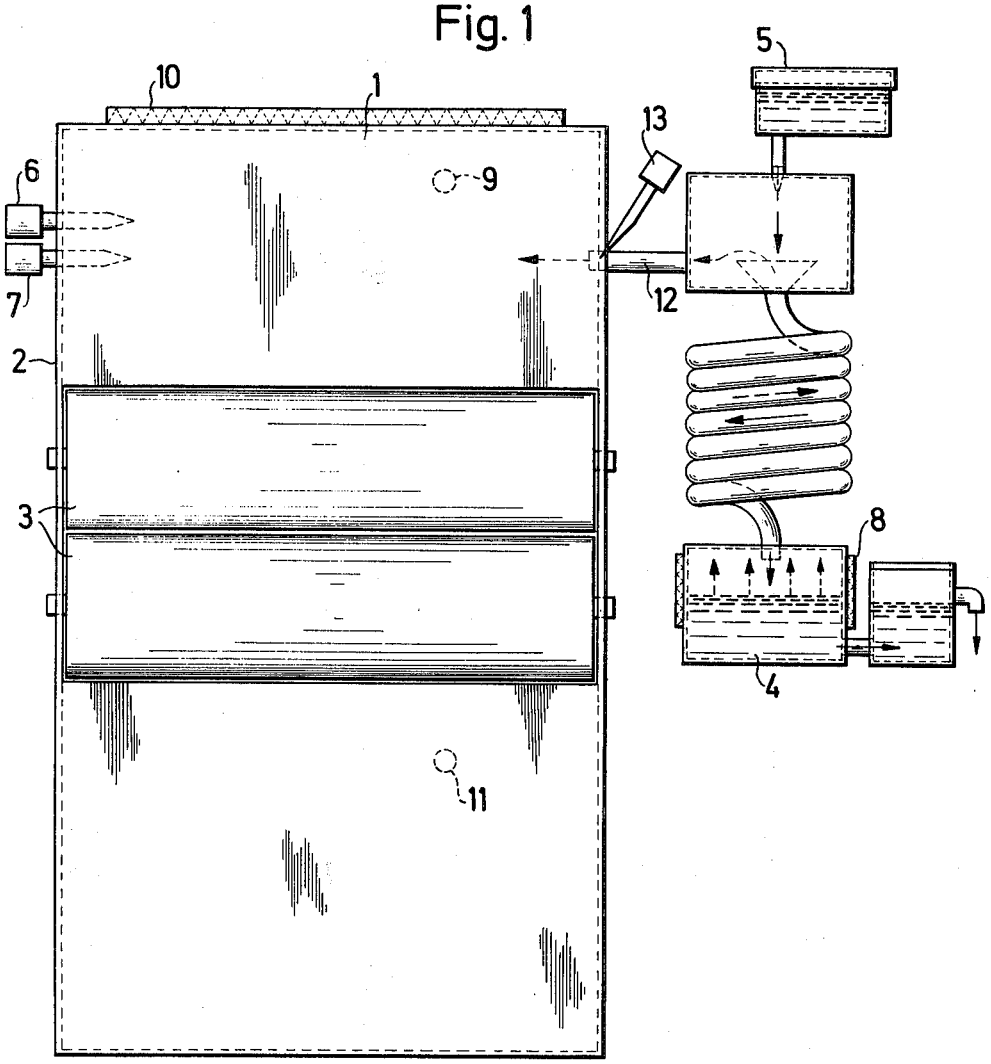

The present invention relates to an apparatus for developing light-sensitive materials, particularly diazotype materials, by means of a gaseous medium, particularly a mixture of ammonia gas and water vapor. The developing apparatus is particularly intended for use as a part of a photocopying machine.

In photocopying machines, the warm-up time of the vaporizer with a properly dimensioned heating means is considerably higher than that of the developing station. Therefore, when operating a photocopying machine, it must be ensured that the temperature in the developing station is sufficient for vaporization of the developer gas before the developer gas is generated in the vaporizer. Otherwise, the developer gas would condense on the cooler areas of the developing station and on the material to be developed.

German Auslegeschrift No. 1,278,239, discloses a temperature control which relieves the operator of estimating the temperature conditions in the developing station. In the developing station described in the said Auslegeschrift, there are provided a trough with a feeding device for ammonia water and a heating device for vaporizing the ammonia water. A heating device for the developing station is also provided. When the apparatus is placed in operation, first both heaters are switched on. As soon as the temperature in the developing station has attained a value at which there is no longer the risk of condensation, a first thermal circuit breaker is actuated, whereby a supply pump in the supply container for the ammonia water is actuated and the ammonia water is fed into the trough. In the developing station, there is a second thermal circuit breaker serving for controlling the heating of the developing station to maintain therein a certain nominal temperature. The just described temperature control is suitable only for vaporizers in which the entire dropwise-added ammonia water vaporizes or in which, at least when the apparatus is placed in operation, no ammonia water or water is in the vaporizer. Otherwise, with the above-mentioned control, water or an ammonia water mixture would vaporize due to the heating of the vaporizer before the temperature of the developing station is sufficiently high. Undesirable condensation thus would result.

More recently, vaporizers have been provided by means of which good utilization of the ammonia water is possible in order to obtain an almost ammonia-free waste water and simultaneously a favorable water vapor/ammonia gas composition in the developing station (see German Pat. applications Nos. P 22 44 384 and P 22 44 422). These vaporizers always contain water or an ammonia water mixture, i.e. also when the apparatus is placed in operation. Developing apparatuses with such vaporizers thus require another temperature control for the above-mentioned reasons.

The object of the present invention is to provide a developing apparatus with a temperature control, which prevents condensation of water vapor in the apparatus, independently of the selection of the specific vaporizer for the production of the developer gas.

The present invention provides an apparatus for developing light-sensitive materials by means of a gaseous medium, which apparatus has a vaporizer inside or outside the developing station and is provided with at least one heating means for the developing station and with at least one heating means for the vaporizer, as well as with at least one temperature controller located inside the developing station.

When the apparatus is placed in operation, the heating means for the developing station is switched on and, when a certain temperature is attained in the developing station, a temperature controller is actuated, by means of which the heating of the vaporizer can be actuated. The developing station reaches its nominal temperature at least at that moment at which the vaporizer reaches its nominal temperature.

In the apparatus of the invention, the developing station is first heated and then the vaporizer, so that the generation of the mixture of ammonia gas and water vapor begins only when the developing station has attained its nominal temperature in order to prevent condensation. At given heating powers of the heating means in the developing station and of the heating means in the vaporizer, the temperature at which the temperature controller is operated and actuates the heating of the vaporizer must be so selected that the developing station reaches its nominal temperature at that moment, at the latest, at which the vaporizer reaches its nominal temperature. If the temperature controller is actuated at a lower temperature, the vaporizer reaches its nominal temperature earlier than the developing station, i.e. ammonia and water vaporizes and the latter condenses in the developing station. The temperature at which the temperature controller is actuated also should not be substantially higher, in order to eliminate an unnecessarily long start-up time for the developing apparatus. The start-up time is that period of time between the placing in operation of the developing apparatus and the time at which the vaporizer has attained its nominal temperature, i.e. the temperature at which sufficient ammonia gas/water vapor is produced so that the materials can be developed. Therefore, the temperature at which the temperature controller is actuated at the given heating powers preferably is so selected that the developing station and the vaporizer attain their respective nominal temperatures simultaneously.

In order to prevent condensation after the start-up time of the apparatus, the nominal temperature of the vaporizer preferably is maintained 5° to 10°C below the nominal temperature of the developing station.

The temperature fluctuation about a nominal value mainly depends on the sensitivity of the temperature controller used, on the storage behavior of the heated object, and on the heating power of the heating means used. Conventional temperature controllers switch-off the heating means when the nominal temperature is exceeded, and switch the heating means on again when the temperature falls below the nominal temperature. Due to its heat-retaining capacity, the heating means supplies heat after disconnection, which leads to a marked rise of the temperature above the nominal value. In the reverse case, it requires a certain time until the switched-on heating power again increases the temperature. Considerable fluctuations about the nominal temperature thus result. Even more considerable fluctuations result when, as illustrated below, temperature controllers with great switching differences are employed. Temperature controllers with feedback, with a corresponding adaption of the feedback, have small fluctuations about a nominal value, but the warm-up time until the nominal value is attained is long. A temperature controller with feedback is a controller in which the switching points are advanced below the nominal temperature and thus the switching frequency is increased.

In order to maintain the warm-up time, and thus the start-up time, of the developing apparatus short, a preferred embodiment of the developing apparatus of the invention includes two heating means for the developing station, which heating means are switched on when the apparatus is placed in operation. The first heating means serves for the rapid warm-up of the developing station and is switched off at a certain temperature by means of a temperature controller. The second heating means is provided for maintaining the nominal temperature after the warm-up time, in order to prevent greater fluctuations about the nominal temperature and is controlled by means of a temperature controller with feedback.

The selection of the temperature at which the first heating means is switched off depends upon the sensitivity of the temperature controller. If the temperature controller has very great switching differences, i.e. if it switches-off the heating means at a certain temperature and switches it on again only when a temperature far below is attained, the switching-off temperature may be selected relatively high. It may occur that the temperature exceeds the nominal value of the developing station but, since the walls and the like are relatively cold and absorb much heat, the temperature drops again rapidly. If, however, a temperature controller with small switching differences is employed, the temperature at which the first heating means is switched off must at any rate be below the nominal temperature of the developing station, since otherwise the first heating means, with a small drop of the temperature in the developing station, would be switched on again by the temperature controller, which would lead to a constant excess of the nominal temperature in the developing station.

Preferably, the same temperature controller is used for switching-off the first heating means in the developing station, and for switching-on the vaporizer heating means, i.e. both operations are performed at the same temperature.

Since temperature controllers with feedback are relatively expensive, another preferred embodiment includes three heating means for the developing station which are switched-on when the apparatus is placed in operation. All data given with respect to the function and switching-off temperature at which the temperature controller is actuated for the first heating means of the above-described embodiment with two heating means for the developing station apply to the first heating means of this embodiment correspondingly. The second heating means is included as a permanent heating means, i.e. it is in operation as long as the apparatus is switched-on. It has a heating power which is sufficient for maintaining a temperature a few degrees Centigrade (e.g. 5°C) below the nominal temperature of the developing station. The third heating means is intended as a controlled heating means. It is connected or disconnected by means of another temperature controller to maintain the nominal temperature in the developing station. In this embodiment, the temperature controller with feedback is replaced by two heating means, a permanent heating means and a controlled heating means which is controlled by a temperature controller. With these two heating means, the same aim is achieved, i.e. the most exact maintenance of the nominal temperature in the developing station. Also in this embodiment, disconnection of the first heating means in the developing station and connection of the vaporizer heating means can occur at the same temperature, i.e. by means of a temperature controller.

Instead of the permanent heating means and the controlled heating means, it is also possible to use a heating means which can be adjusted to two heating powers. When the temperature controller is actuated, the heating means is not switched-off but is adjusted to the lower heating power, which is so selected that it can maintain the developing station at a temperature a few degrees Centigrade below the nominal temperature. The upper heating power is so selected that it is sufficient for maintaining the nominal temperature of the developing station. The temperature controller thus switches from the lower to the upper heating power, and vice versa.

Since the temperature of the mixture of ammonia gas and water vapor is important for the development of the materials exposed to light, the temperature of the mixture of ammonia gas and water vapor, i.e. the nominal temperature of the vaporizer, preferably is maintained constant at the optimum value for development. This is advantageously achieved by a temperature controller for controlling the vaporizer heating means which controller is located at the vaporizer outlet of the gas mixture.

As long as the vaporizer has not attained the temperature necessary for vaporization, no ammonia water should be added thereto since otherwise ammonia water of a high ammonia content would be discharged from the outlet of the vaporizer and thus into the waste water. In order to prevent this, the temperature controller at the vaporizer outlet may actuate an indicating device, e.g. a lamp, as soon as the nominal temperature of the vaporizer, or a temperature a few degrees Centigrade below that temperature, is attained, which indicating device indicates to the operator that the ammonia water supply may be switched-on. This procedure also may be automated in that, when the nominal temperature of the vaporizer, or a temperature a few degrees below that temperature is attained, the temperature controller actuates a valve whereby the ammonia water supply into the vaporizer begins.

As the vaporizer heating means, there preferably may be used a heating means which is adjustable to two heating powers. In this case, the lower heating power is so selected that it is sufficient for maintaining the nominal temperature of the vaporizer when no ammonia water is added thereto, i.e., when no substantial cooling occurs. The upper heating power of the vaporizer heating means is so selected that it is sufficient for maintaining the nominal temperature when ammonia water is added to the vaporizer. When the nominal temperature of the vaporizer is exceeded, the temperature controller in the vaporizer outlet thus does not switch-off the vaporizer heating means but switches it to its lower heating power and, when the temperature falls below the nominal temperature, it switches it again to its upper heating power.

Figure 2:
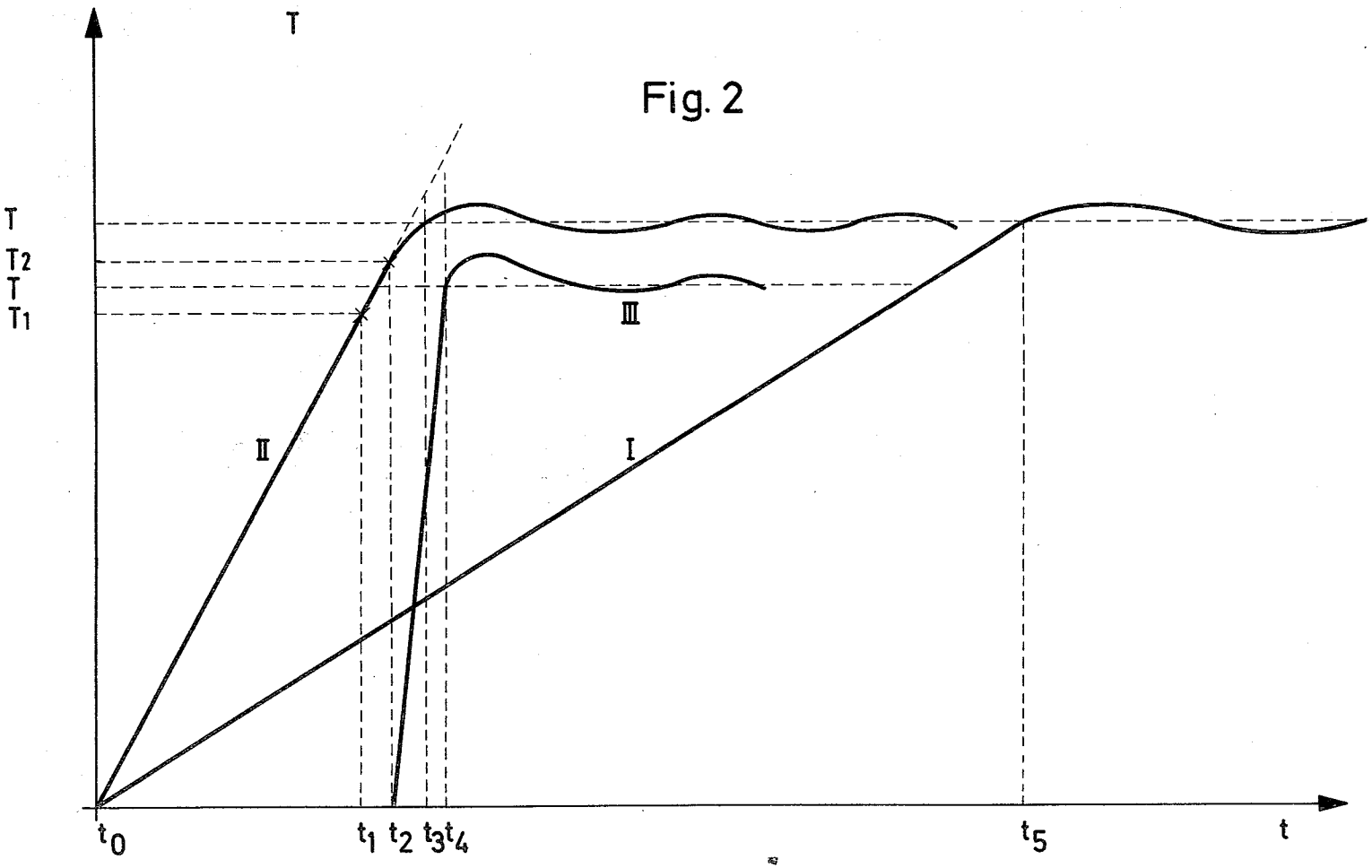
Figure 3:
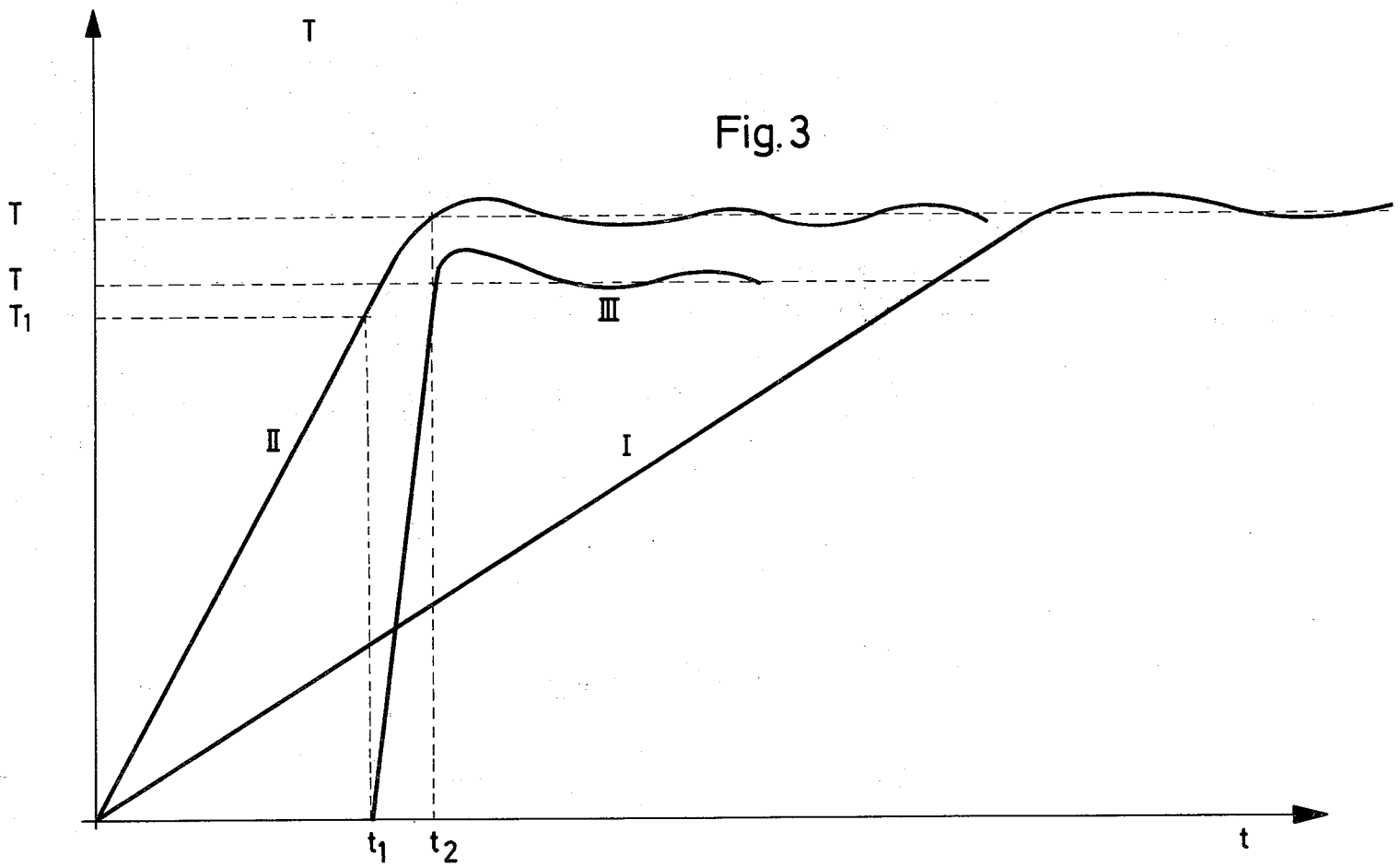

The invention will be further illustrated by reference to the accompanying drawings, in which FIG. 1 is a view in elevation of a preferred embodiment of the developing apparatus in the zone of a pair of feed rolls, FIG. 2 is a time/temperature diagram of one embodiment of the developing apparatus, and FIG. 3 is a time/temperature diagram for the embodiment of the developing apparatus shown in FIG. 1.

In FIG. 1, the developing station 1 is enclosed by the housing 2. The exposed material to be developed is introduced into the apparatus between the pair of feed rolls 3, passes through the rolls and is discharged from the apparatus through a pair of discharge rolls, not shown in FIG. 1. In the apparatus shown in FIG. 1, the vaporizer 4 for the ammonia water is located outside of the developing station. The vaporizer operates according to the rectification principle, as described in German Pat. application No. P 22 44 384. On the vaporizer 4, there is mounted an ammonia water supply container 5 from which the ammonia water is dropwise introduced into the vaporizer 4. In the developing station 1, there are located the temperature sensors of the temperature controllers 6 and 7. The temperature controller 6 serves for switching-on the vaporizer heating means 8 and for switching-off the first heating means 9 of the developing station 1, whereas the temperature controller 7 controls the third heating means 11 for the maintenance of the nominal temperature of the developing station 1. Whereas the first heating means 9, which is switched-on only during the warm-up period, and the third controlled heating means 11 are located in the interior of the developing station 1, the second heating means 10 which heats continuously as long as the apparatus is in operation, is located outside of the developing station 1. At the outlet 12 of the vaporizer 4 is located the temperature sensor of the temperature controller 13 which controls the vaporizer heating means 8 for maintaining the nominal temperature in the vaporizer 4.

In the time/temperature diagram of FIG. 2, the temperature curve of the developing station 1 is designated by II and the temperature curve of the vaporizer 4 by III. Curve I is the temperature curve of the developing station 1 when only one heating means is used and which is controlled by means of a temperature controller with feedback. The temperature curve II in FIG. 2 is the temperature curve for an embodiment not illustrated in FIG. 1, in which the first heating means 9 of the developing station 1 is switched-off at a temperature other than that at which the vaporizer heating means 8 is switched-on. In this embodiment, a third temperature controller for the developing station is thus necessary.

The apparatus is switched-on at the time $t_0$, all three heating means of the developing station 1 being switched on also, in order to warm it up. When the temperature $T_1$ is attained at the time $t_1$, this time being determined by the powers of the three heating means and the specific form, e.g. size of the developing station 1, a first temperature controller is actuated and switches-off the first heating means of the developing station 1. When the temperature $T_2$ is attained at the time $t_2$, a second temperature controller in the developing station is actuated and switches-on the vaporizer heating means 8. At the time $t_3$, the developing station 1 attains its nominal temperature and shortly thereafter at the time $t_4$ the vaporizer 4 attains its nominal temperature, i.e. photocopies can be developed. If only one heating means controlled by a temperature controller with feedback is used in the developing station, the apparatus is ready for the development of photocopies only at the time $t_5$.

FIG. 3 shows the time/temperature diagram for the embodiment shown in FIG. 1. The curves I, II, and III have the same meanings as in FIG. 2. When the temperature $T_1$ is attained in the developing station 1 at the time $t_1$ (e.g. after 8 to 9 minutes) the temperature controller 6 is actuated, switches-on the heating means 8 of the vaporizer 4, and switches-off the first heating means 9 of the developing station 1. At the time $t_2$ (e.g. after 17 to 18 minutes) the developing station 1 and the vaporizer 4 simultaneously attain their respective nominal temperatures, the nominal temperature of the vaporizer 4 being 70°C and that of the developing station 1 being 75°C.

The various heating means are conventional electric heaters and therefore are not further described.

It will be obvious to those skilled in the art that many modifications may be made within the scope of the present invention without departing from the spirit thereof, and the invention includes all such modifications.

What is claimed is:

1. Apparatus for developing light-sensitive material with a gaseous medium having a predetermined dew point comprising developing station means in communication with vaporizer means, at least one heating means in each of said developing station means and vaporizer means, at least one temperature control means inside said developing station means, said temperature control means being connected to the heating means in the developing station means and said heating means in said vaporizer means, said temperature control means being adjusted to control the heating of the developing station means to a predetermined temperature exceeding the dew point of the gaseous medium, whereby in said developing station means any condensation is prevented, said control means at a certain temperature in said developing station means actuating said heating means in said vaporizer means, said certain temperature being lower than said predetermined temperature, and said developing station means attaining its predetermined temperature prior to the vaporizer means producing the gaseous medium.

2. Apparatus for developing light-sensitive material with a gaseous medium having a predetermined dew point comprising developing station means in communication with vaporizer means, at least one heating means in each of said developing station means and vaporizer means, at least one temperature control means inside said developing station means, said temperature control means being connected to the heating means in the developing station means and said heating means in said vaporizer means, said temperature control means being adjusted to control the heating of the developing station means to a predetermined temperature exceeding the dew point of the gaseous medium, whereby in said developing station means any condensation is prevented, said control means at a certain temperature in said developing station means actuating said heating means in said vaporizer means, said certain temperature being lower than said predetermined temperature, and said developing station means attaining its predetermined temperature simultaneously with the vaporizer means producing the gaseous medium.

3. Apparatus for developing light-sensitive material with a gaseous medium having a predetermined dew point comprising developing station means in communication with vaporizer means, at least one heating means in each of said developing station means and vaporizer means, at least one temperature control means inside said developing station means, said temperature control means being connected to the heating means in the developing station means and said heating means in said vaporizer means, said temperature control means being adjusted to control the heating of the developing station means to a predetermined temperature exceeding the dew point of the gaseous medium, whereby in said developing station means any condensation is prevented, said control means at a certain temperature in said developing station means actuating said heating means in said vaporizer means, said certain temperature being lower than said predetermined temperature, and said developing station means attaining its predetermined temperature prior to or simultaneously with the vaporizer means producing the gaseous medium, said vaporizer means producing the gaseous medium at a temperature 5° to 10°C below the predetermined temperature of said developing station means.

4. Apparatus for developing light-sensitive material with a gaseous medium having a predetermined dew point comprising developing station means in communication with vaporizer means having outlet means for the gaseous medium, at least one heating means in each of said developing station means and vaporizer means, at least one temperature control means inside said developing station means, said temperature control means being connected to the heating means in the developing station means and said heating means in said vaporizer means, said temperature control means being adjusted to control the heating of the developing station means to a predetermined temperature exceeding the dew point of the gaseous medium, whereby in said developing station means any condensation is prevented, said control means at a certain temperature in said developing station means actuating said heating means in said vaporizer means, said certain temperature being lower than said predetermined temperature, said developing station means attaining its predetermined temperature prior to or simultaneously with the vaporizer means producing the gaseous medium, and a second temperature control means at said outlet means for controlling the at least one heating means of said vaporizer means.

5. Apparatus for developing light-sensitive material with a gaseous medium having a predetermined dew point comprising developing station means in communication with vaporizer means having outlet means for the gaseous medium, at least one heating means in each of said developing station means and vaporizer means, at least one temperature control means inside said developing station means, said temperature control means being connected to the heating means in the developing station means and said heating means in said vaporizer means, said temperature control means being adjusted to control the heating of the developing station means to a predetermined temperature exceeding the dew point of the gaseous medium, whereby in said developing station means any condensation is prevented, said control means at a certain temperature in said developing station means actuating said heating means in said vaporizer means, said certain temperature being lower than said predetermined temperature, said developing station means attaining its predetermined temperature prior to or simultaneously with the vaporizer means producing the gaseous medium, and a second temperature control means at said outlet means for controlling the at least one heating means of said vaporizer means to maintain a minimum temperature therein, said last-mentioned heating means being adjustable between a lower and an upper heating power, said second temperature control means switching said last-mentioned heating means to the lower heating power when said minimum temperature is exceeded, said lower heating power being sufficient to maintain said predetermined temperature in said vaporizer means.

6. Apparatus for developing light-sensitive material with a gaseous medium having a predetermined dew point comprising developing station means in communication with vaporizer means, at least one heating means in said vaporizer means, two heating means and two temperature control means in said developing station means, one of said two temperature control means being connected to one of the heating means in the developing station means and said heating means in said vaporizer means, the other of said two temperature control means being connected to the other one of the heating means in the developing station means, the first-mentioned one of said two heating means serving for the rapid warm-up of said developing station means and being switched-off by said temperature control means connected thereto when a predetermined temperature is attained in said developing station means, the other one of said two heating means maintaining the predetermined temperature in said developing station means and being switched-on and off by said temperature control means connected thereto, whereby the predetermined temperature in said developing station means is maintained, said one temperature control means being adjusted to control the heating of the developing station means to said predetermined temperature exceeding the dew point of the gaseous medium, whereby in said developing station means any condensation is prevented, said one temperature control means at a certain temperature in said developing station means actuating said heating means in said vaporizer means, said certain temperature being lower than said predetermined temperature, and said developing station means attaining its predetermined temperature prior to or simultaneously with the vaporizer means producing the gaseous medium.

7. Apparatus for developing light-sensitive material with a gaseous medium having a predetermined dew point comprising developing station means in communication with vaporizer means, at least one heating means in said vaporizer means, two heating means and two temperature control means in said developing station means, one of said two temperature control means being connected to one of the heating means in the developing station means and said heating means in said vaporizer means, the other of said two temperature control means being connected to the other one of the heating means in the developing station means, the first-mentioned one of said two heating means serving for the rapid warm-up of said developing station means and being switched-off by said temperature control means connected thereto when a predetermined temperature is attained in said developing station means, the other one of said two heating means maintaining the predetermined temperature in said developing station means and being switched-on and off by said temperature control means connected thereto, whereby the predetermined temperature in said developing station means is maintained and when said temperature control means for switching-off the heating means serving for the rapid warm-up of the developing station means is actuated, said heating means in said vaporizer means is switched-on and the heating means serving for the rapid warm-up of the developing station means is switched off, said one temperature control means being adjusted to control the heating of the developing station means to said predetermined temperature exceeding the dew point of the gaseous medium, whereby in said developing station means any condensation is prevented, said one temperature control means at a certain temperature in said developing station means actuating said heating means in said vaporizer means, said certain temperature being lower than said predetermined temperature, and said developing station means attaining its predetermined temperature prior to or simultaneously with the vaporizer means producing the gaseous medium.

8. Apparatus for developing light-sensitive material with a gaseous medium having a predetermined dew point comprising developing station means in communication with vaporizer means, at least one heating means in said vaporizer means, three heating means and two temperature control means in operative association with said developing station means, a first one of said three heating means serving for the rapid warm-up of said developing station means and being switched-off by one of said two temperature control means when a predetermined temperature is attained in said developing station means, a second one of said three heating means operating continuously to maintain a temperature in said developing station means a few degrees Centigrade below the predetermined temperature of the developing station means, and the third one of said three heating means maintaining the predetermined temperature in said developing station means and being switched-on and off by the other one of said two temperature control means, whereby the predetermined temperature in said developing station means is maintained, said one temperature control means being adjusted to control the heating of the developing station means to said predetermined temperature exceeding the dew point of the gaseous medium, whereby in said developing station means any condensation is prevented, said one temperature control means at a certain temperature in said developing station means actuating said heating means in said vaporizer means, said certain temperature being lower than said predetermined temperature, and said developing station means attaining its predetermined temperature prior to or simultaneously with the vaporizer means producing the gaseous medium.

* * * * *

UNITED STATES PATENT OFFICE

CERTIFICATE OF CORRECTION

PATENT NO. : 3,943,538

DATED : March 9, 1976

INVENTOR(S) : Horst Hilgers and Herbert Schröter

It is certified that error appears in the above-identified patent and that said Letters Patent are hereby corrected as shown below:

Column 8, penultimate line of Claim 5, "predetermined" should read - - - minimum - - -.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*